US008743049B2

(12) United States Patent
Yamazaki

(10) Patent No.: US 8,743,049 B2
(45) Date of Patent: Jun. 3, 2014

(54) ELECTROPHORETIC DISPLAY DEVICE, METHOD OF DRIVING THE SAME, AND ELECTRONIC DEVICE

(75) Inventor: Katsunori Yamazaki, Matsumoto (JP)

(73) Assignee: Seiko Epson Corporation (JP)

( * ) Notice: Subject to any disclaimer, the term of this patent is extended or adjusted under 35 U.S.C. 154(b) by 742 days.

(21) Appl. No.: 12/907,063

(22) Filed: Oct. 19, 2010

(65) Prior Publication Data

US 2011/0096053 A1 Apr. 28, 2011

(30) Foreign Application Priority Data

Oct. 22, 2009 (JP) ..... 2009-243386

(51) Int. Cl.
*G09G 3/34* (2006.01)
*G09G 5/00* (2006.01)

(52) U.S. Cl.
CPC ..... *G09G 3/344* (2013.01)
USPC ..... 345/107; 345/211

(58) Field of Classification Search
CPC .... G09G 3/3233; G09G 3/3225; G09G 3/344
USPC ..... 345/107, 211
See application file for complete search history.

(56) References Cited

U.S. PATENT DOCUMENTS

| | | | | |
|---|---|---|---|---|
| 7,880,695 | B2 | 2/2011 | Yamashita et al. | |
| 8,144,116 | B2 | 3/2012 | Nagayama | |
| 2005/0068279 | A1 | 3/2005 | Hirota et al. | |
| 2007/0040450 | A1 * | 2/2007 | Chung | 307/109 |
| 2007/0120812 | A1 * | 5/2007 | Nagayama | 345/107 |
| 2007/0297559 | A1 * | 12/2007 | Cho et al. | 377/64 |
| 2008/0198104 | A1 * | 8/2008 | Yamashita et al. | 345/77 |

FOREIGN PATENT DOCUMENTS

| | | | |
|---|---|---|---|
| JP | 2005351993 | A | 12/2005 |
| JP | 2008-176330 | | 7/2008 |
| JP | 2008203659 | A | 9/2008 |

* cited by examiner

*Primary Examiner* — Chanh Nguyen
*Assistant Examiner* — John Kirkpatrick
(74) *Attorney, Agent, or Firm* — Harness, Dickey & Pierce, P.L.C.

(57) ABSTRACT

An electrophoretic includes scanning lines, data lines, power supply lines and enable lines provided in a display section. The electrophoretic display device also includes, in each of pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode. The enable transistor switches electrical connection between the pixel electrode and the driving transistor on the basis of a signal input through one of the enable lines.

12 Claims, 11 Drawing Sheets

ELECTROPHORETIC DISPLAY DEVICE, METHOD OF DRIVING THE SAME, AND ELECTRONIC DEVICE

BACKGROUND

1. Technical Field

The present invention relates to an electrophoretic display device, a method of driving the electrophoretic display device, and an electronic device.

2. Related Art

There is known an electrophoretic display device including, in pixels, control transistors, storage capacitors and driving transistors. See, for example, JP-A-2008-176330. In a pixel of such an electrophoretic display device disclosed in the document, a storage capacitor is charged by an image signal input through a control transistor, and a driving transistor supplies to a pixel electrode a current corresponding to the voltage of the storage capacitor. Thus, display with brightness in accordance with the amount of electric charge (current×time) is obtained.

In a pixel described in JP-A-2008-176330, a current $I_s$ that the driving transistor supplies is expressed by the following equation:

$$I_s = \frac{1}{2}\frac{W}{L}C_{ox}\mu(V_g - V_s - V_{th})^2$$

where:

W is the channel width;

L is the channel length;

$C_{ox}$ is a constant represented by the expression $\in_{ox}/t_{ox}$ ($\in_{ox}$: the dielectric constant of a gate oxide film, $t_{ox}$: the thickness of a gate insulating film);

$\mu$ is the mobility;

$V_{th}$ is the threshold voltage; and $V_g$ and $V_s$ are the gate voltage and the source voltage, respectively.

In the above equation, W, L, $C_{ox}$, $\mu$ and $V_{th}$ vary from the transistor of one pixel to that of another. This leads to a variation in the current $I_s$ from one pixel to another, which causes differences in display gradation. Thus, display irregularities occur. Hereinafter, the product term $(W/L)C_{ox}\mu$ in the above equation is collectively referred to as "mobility, etc."

SUMMARY

One advantage of some aspects of the invention is that an electrophoretic display device capable of display with reduced irregularities and a method of driving the electrophoretic display device are provided.

An electrophoretic display device according to a first aspect of the invention is configured such that an electrophoretic element is sandwiched between a pair of substrates, and includes a display section having a plurality of pixels arranged therein. The electrophoretic display device includes scanning lines, data lines, power supply lines and enable lines provided in the display section. The scanning lines, the data lines, the power supply lines and the enable lines are connected to the pixels. The electrophoretic display device also includes, in each of the pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode. The enable transistor switches electrical connection between the pixel electrode and the driving transistor on the basis of a signal input through one of the enable lines.

With this configuration, electrical connection between the driving transistor and the pixel electrode can be switched by the enable transistor. Therefore, before the electrophoretic element is driven to display an image, operations of correcting the threshold voltage and mobility of the driving transistor can be performed under a condition in which the pixel electrode is electrically disconnected using the enable transistor. While the electrophoretic element has a resistive component and therefore the threshold voltage correcting and the mobility correcting cannot be accurately performed under a condition in which the driving transistor and the pixel electrode are electrically connected, the correcting operations can be accurately performed according to the first aspect of the invention.

As such, according to the first aspect of the invention, it is possible to obtain uniform display in which display irregularities are reduced.

It is preferable that a controller for controlling the display section be further included, and that the controller perform, when displaying an image on the display section, an initialization driving operation for initializing a source potential and a gate potential of the driving transistor to have a certain potential relationship, a threshold voltage correcting operation for correcting a threshold voltage of the driving transistor, a mobility correcting operation for correcting mobility of the driving transistor, and an image displaying operation for driving the electrophoretic element.

With this configuration, the threshold voltage and mobility of the driving transistor are corrected in each pixel. This makes it possible to provide the electrophoretic display device capable of display in which display irregularities are effectively reduced.

It is preferable that the controller turn off the enable transistor in periods of the threshold voltage correcting operation and the mobility correcting operation. This allows preventing a current from flowing into the pixel electrode during the correction operations, which enables correction of the driving transistor to be accurately performed.

It is preferable that an enable line control circuit be further included that has switch circuits provided so as to correspond to a plurality of the enable lines, and a first power supply line and a second power supply line be further included that are connected to the enable line control circuit, and that one of the switch circuits have a first transistor inserted between one of the enable lines and the first power supply line and a second transistor inserted between the enable line and the second power supply line, a gate of the first transistor be connected to a first one of the scanning lines to which the switch circuit belongs, and a gate of the second transistor be connected to a second one of the scanning lines that is different from the first scanning line.

With this configuration, it is possible to provide the electrophoretic display device in which on-off control of the enable transistor is performed in synchronization with the operation of selecting a scanning line.

It is also preferable that a third power supply line connected to the enable line control circuit be further included, and that the switch circuit have a third transistor inserted between the enable line and the third power supply line, and a gate of the third transistor be connected to a third one of the scanning lines or another control line, the third scanning line being different from the first and second scanning lines.

With this configuration, the enable transistor can be controlled more finely by utilizing the operation of switching the third transistor.

It is also preferable that the switch circuit have a capacitor having one electrode connected to the enable line. With this configuration, it is possible to extend the duration of the on-state of the enable transistor. This makes it possible to reliably secure connection between the driving transistor and the pixel electrode in a period in which current supply to the pixel electrode is required.

It is preferable that a potential control circuit be further included that has a plurality of the power supply lines formed so as to correspond to the scanning lines and switch circuits provided so as to correspond to the power supply lines, and a fourth power supply line and a fifth power supply line be further included that are connected to the potential control circuit; that one of the switch circuits have a fourth transistor inserted between one of the power supply lines and the fourth power supply line, a fifth transistor inserted between the power supply line and the fifth power supply line, a sixth transistor inserted between a gate of the fifth transistor and a first power supply for outputting a potential that turns off the fifth transistor, and a seventh transistor inserted between a gate of the fifth transistor and a second power supply for outputting a potential that turns on fifth transistor; and that a gate of the fourth transistor and a gate of the sixth transistor be connected to a first one of the scanning lines to which the switch circuit belongs, whereas a gate of the seventh transistor be connected to a second one of the scanning lines that is different from the first scanning line.

With this configuration, it is possible to provide the electrophoretic display device in which the potential of the power supply line can be selected and controlled in synchronization with the operation of selecting a scanning line.

It is preferable that the switch circuit have a capacitor having one electrode connected to the gate of the fifth transistor. With this configuration, it is possible to extend the duration of the on-state or the off-state of the fifth transistor. This makes it possible to reliably supply power in a period in which power supply is required.

In the above-described electrophoretic display device including the potential control circuit, the enable line control circuit described previously may be further included. This enables the power supply to the driving transistor and the operation of switching the enable transistor to be controlled in synchronization with the operation of selecting a scanning line.

Next, a method of driving an electrophoretic display device according to a second aspect of the invention is a method of driving an electrophoretic display device that is configured such that an electrophoretic element is sandwiched between a pair of substrates, and includes a display section having a plurality of pixels arranged therein. The electrophoretic display device includes scanning lines, data lines, power supply lines and enable lines provided in the display section, the scanning lines, the data lines, the power supply lines and the enable lines connected to the pixels. The electrophoretic display device also includes, in each of the pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode. The enable transistor switches electrical connection between the pixel electrode and the driving transistor on the basis of a signal input through one of the enable lines. The method includes displaying an image on the display section. The displaying includes initializing a source potential and a gate potential of the driving transistor to have a certain potential relationship, correcting a threshold voltage of the driving transistor, correcting mobility of the driving transistor, and driving the electrophoretic element. In the correcting of the threshold voltage and the correcting of the mobility, the enable transistor is in the off-state.

With this method, before the electrophoretic element id driven to display an image, operations of correcting the threshold voltage and correcting the mobility of the driving transistor can be performed under a condition in which the pixel electrode is electrically disconnected by using the enable transistor. While the electrophoretic element has a resistive component and therefore correcting the threshold voltage and correcting the mobility cannot be accurately performed under a condition in which the driving transistor and the pixel electrode are electrically connected, the correcting operations can be accurately performed according the second aspect of the invention.

Thus, according to the second aspect of the invention, it is possible to obtain uniform display in which display irregularities are reduced.

It is also preferable that on-off control of the enable transistor be performed by using a potential of a first one of the scanning lines, the first scanning line being connected to the pixel to which the enable transistor in question belongs, and a potential of a second one of the scanning lines, the second scanning line being different from the first scanning line.

With this method, the drive circuit for controlling the enable line need not be provided in the outside, and thus the configuration of wiring and the drive circuit can be simplified.

It is also preferable that, after the on-off control has been performed by using the potentials of the first and second scanning lines, on-off control of the enable transistor be performed by using a potential of a third one of the scanning lines, the third scanning line being different from the first and second scanning lines.

With this method, the enable transistor can be controlled more finely. This allows a driving mode having a higher degree of flexibility to be adopted.

It is also preferable that a potential supplied to the power supply line be switched in synchronization with an operation of selecting a first one of the scanning lines that is connected to the same one of the pixels as the power supply line, and an operation of selecting a second one of the scanning lines that is subsequent to the first scanning line.

With this method, the drive circuit for controlling the power supply line connected to the driving transistor need not be provided outside, and thus the configuration of wiring and the drive circuit can be simplified.

An electronic device according to a third aspect of the invention includes the electrophoretic display device described previously.

With this configuration, it is possible to provide an electronic device including a displaying portion capable of high quality display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
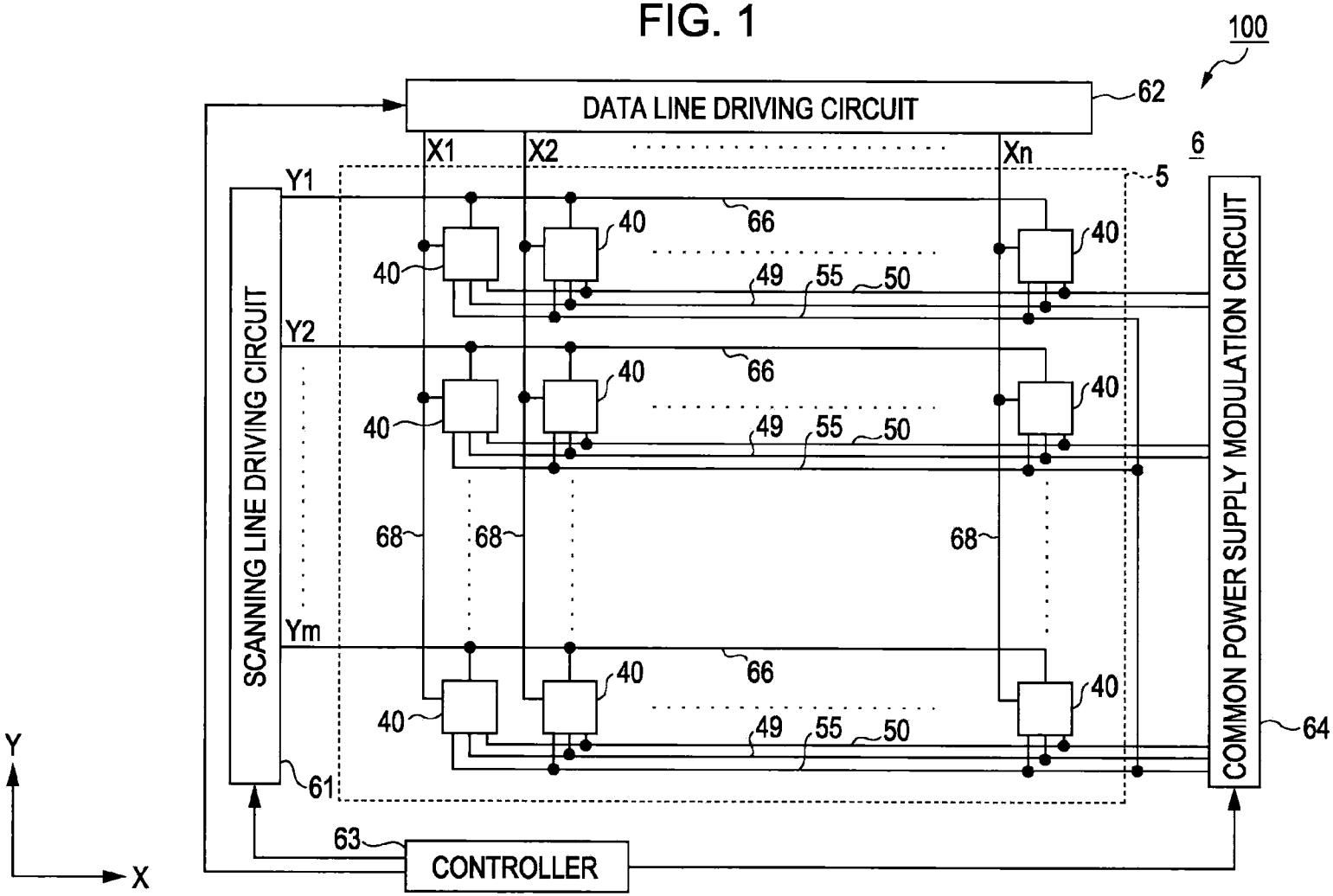
FIG. 1 is a schematic block diagram of an electrophoretic display device according to a first embodiment.

Embodiments of the invention will be described below with reference to the accompanying drawings.

It should be noted that the scope of the invention is not limited to the embodiments, and can be freely changed within the scope of the technical idea of the invention. In addition, in the drawings to which reference will be made, scales and the numbers of components in each structure may be different from those in the actual structure in order to make each configuration easier to understand.

First Embodiment

FIG. 1 is a schematic block diagram of an electrophoretic display device 100 according to an embodiment of the invention.

The electrophoretic display device 100 includes a display section 5 in which a plurality of pixels 40 is arranged in a matrix. A scanning line driving circuit 61, a data line driving circuit 62, a controller 63 and a common power supply modulation circuit 64 are disposed around the display section 5. The scanning line driving circuit 61, the data line driving circuit 62 and the common power supply modulation circuit 64 are each connected to the controller 63. The controller 63 totally controls these components on the basis of image data and synchronizing signals supplied from a higher level device.

In the display section 5, a plurality of scanning lines 66 extending from the scanning line driving circuit 61 and a plurality of data lines 68 extending from the data line driving circuit 62 are formed, and pixels 40 are provided at positions corresponding to those of intersection of the scanning lines 66 and the data lines 68. Enable lines 49, power supply lines 50 and common electrode wiring 55, which extend from the common power supply modulation circuit 64, are provided, and each of the aforementioned is connected to the pixels 40. The enable line 49 and the power supply line 50 are provided so as to correspond to the scanning line 66 of each row. The common power supply modulation circuit 64 is configured to allow potentials to be input individually to the enable line 49 and the power supply line 50 of each row.

Note that the common electrode wiring 55 is electrical connection, which is expressed as wiring for the sake of convenience, between a common electrode 37, which is an electrode common to the plurality of pixels 40 of the display section 5 (see FIG. 2 and FIGS. 3A and 3B), and the common power supply modulation circuit 64.

The scanning line driving circuit 61 is connected to each of the pixels 40 through m scanning lines 66 (Y1, Y2, . . . , Ym). Under control of the controller 63, scanning line driving circuit 61 sequentially selects the scanning lines 66 from a 1st row to an m-th row and supplies through the selected scanning line 66 a selection signal defining the timing of turning on a control transistor TRc (see FIG. 2) provided in the pixel 40. The data line driving circuit 62, which is connected to each of the pixels 40 through n data lines 68 (X1, X2, . . . , Xn), supplies, under control of the controller 63, an image signal defining image data corresponding to each of the pixels 40 to that pixel 40. The common power supply modulation circuit 64, under control of the controller 63, generates various signals to be supplied to the above-mentioned lines, and causes electrical connection and disconnection (causing a high impedance (Hi-Z)) of the lines.

Note that, in this embodiment, a low-level (L) image signal is supplied to the pixel 40 in the case of defining image data "0" (white), whereas a high-level (H) image signal is supplied to the pixels 40 in the case of defining image data "1" (black). An image signal at a level between L and H is supplied to the pixel 40 in the case of defining image data having an intermediate gray scale level.

Figure 2:
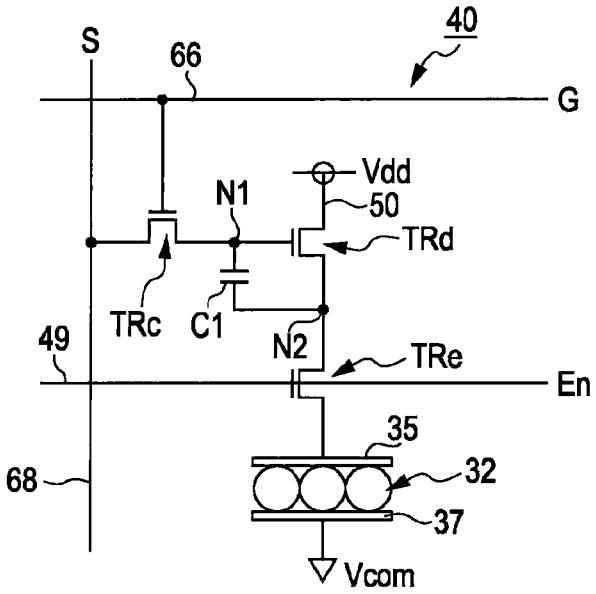
FIG. 2 is a circuit configuration diagram of a pixel.

FIG. 2 is a circuit configuration diagram of the pixel 40.

Provided in the pixel 40 are the control transistor TRc, a driving transistor TRd, an enable transistor TRe, a storage capacitor C1, a pixel electrode 35, an electrophoretic element 32 and a common electrode 37. Connected to the pixel 40 are the scanning line 66, the data line 68, the enable line 49 and the power supply line 50. The control transistor TRc, the driving transistor TRd and the enable transistor TRe are all N-MOS (Negative Metal Oxide Semiconductor) transistors.

Note that the control transistor TRc, the driving transistor TRd and the enable transistor TRe may be replaced with other kinds of switching elements having functions equivalent to those of the control transistor TRc, the driving transistor TRd and the enable transistor TRe. For example, in place of an N-MOS transistor, a P-MOS (Positive MOS) transistor may be used, and an inverter and a transmission gate may also be used.

More particularly, the scanning line 66 is connected to the gate of the control transistor TRc, and the data line 68 is connected to the source of the control transistor TRc. The drain of the control transistor TRc is connected to the gate of the driving transistor TRd and one electrode of the storage capacitor C1. The drain of the driving transistor TRd is connected to the power supply line 50, and the source of the driving transistor TRd is connected to the other electrode of the storage capacitor C1 and the drain of the enable transistor TRe. The enable line 49 is connected to the gate of the enable transistor TRe, and the pixel electrode 35 is connected to the source of the enable transistor TRe. The electrophoretic element 32 is sandwiched between the pixel electrode 35 and the common electrode 37.

In the pixels 40, the control transistor TRc is a switching element for controlling input of an image signal to the pixel 40, and the storage capacitor C1 is charged by an image signal supplied through the control transistor TRc. The driving transistor TRd is driven by the voltage of the storage capacitor C1 to supply a current corresponding to the charge level of the storage capacitor C1 to the side of the pixel electrode 35. The enable transistor TRe controls the flow of a current from the driving transistor TRd into the pixel electrode 35.

Figure 3A:
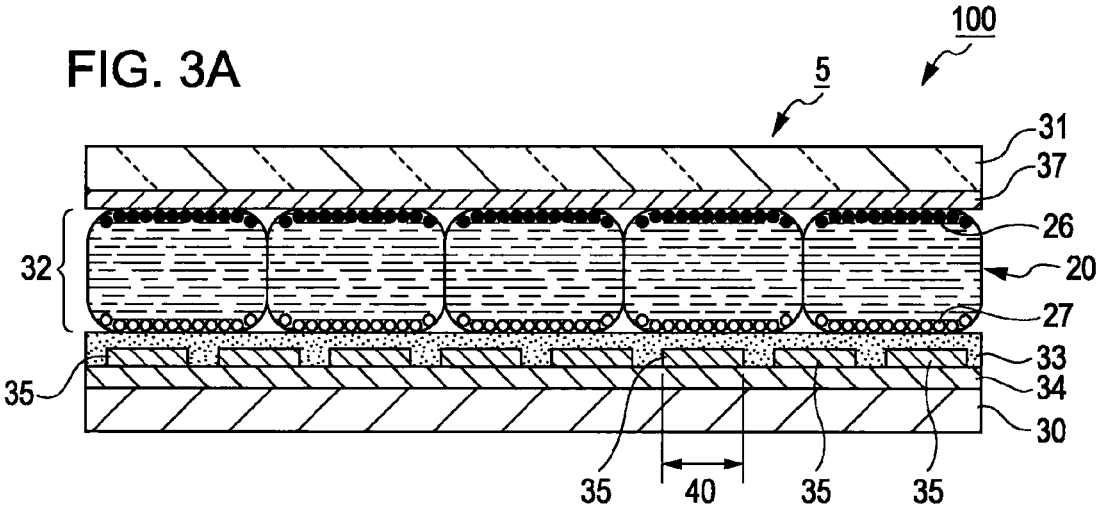
FIGS. 3A and 3B are sectional views showing the main parts of the electrophoretic display device according to the first embodiment.

Next, FIG. 3A is a partial sectional view of the electrophoretic display device 100 in the display section 5. The electrophoretic display device 100 has a configuration in which the electrophoretic element 32 having a plurality of microcapsules 20 arranged therein is sandwiched between an element substrate (first substrate) 30 and a counter substrate (second substrate) 31.

In the display section 5, provided on the side facing the electrophoretic element 32 of the element substrate 30 is a circuit layer 34 in which the scanning line 66, the data line 68, the control transistor TRc, the driving transistor TRd and the like, which are shown in FIGS. 1 and 2, are formed. A plurality of pixel electrodes 35 is formed and arranged on the circuit layer 34.

The element substrate 30 is a substrate made of glass, plastic or the like, and does not have to be transparent because it is disposed on the side opposite to the side on which an image is displayed. The pixel electrode 35 is an electrode for applying voltage to the electrophoretic element 32, and is made up of a nickel plate and a gold plate laminated in this order on copper (Cu) foil, or an electrode that is formed of aluminum (Al), indium tin oxide (ITO) or the like.

On the other hand, formed on the side facing the electrophoretic element 32 of the counter substrate 31 is the planar-shaped common electrode 37 opposite to the plurality of pixel electrodes 35, and the electrophoretic element 32 is provided on the common electrode 37.

The counter substrate 31 is a substrate made of glass, plastic or the like, and is made as a transparent substrate because it is disposed on the side on which an image is displayed. The common electrode 37, as well as the pixel electrode 35, is an electrode for applying voltage to the electrophoretic element 32, and a transparent electrode formed of magnesium silver (MgAg), ITO, indium zinc oxide (IZO) or the like.

The electrophoretic element 32 and the pixel electrodes 35 are adhered to each other through an adhesive layer 33, which results in connection between the element substrate 30 and the counter substrate 31.

Note that, usually, the electrophoretic element 32 is formed in advance on the side of the counter substrate 31 and is handled as an electrophoretic sheet including the adhesive layer 33. In the manufacturing process, the electrophoretic sheet is handled in a state in which a protective release sheet is attached to the surface of the adhesive layer 33. Then, the electrophoretic sheet from which the protective release sheet has been removed is attached to the surface of the element substrate 30 (on which the pixel electrodes 35 and various circuits are formed) which has been separately manufactured, and thus the display section 5 is formed. For this reason, the adhesive layer 33 exists only on the side of the pixel electrodes 35.

Figure 3B:
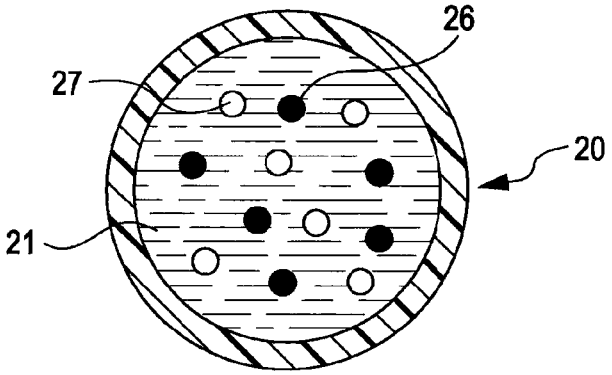

FIG. 3B is a schematic sectional view of the microcapsule 20. The microcapsule 20 has a particle diameter of about 50 μm, for example, and is a spherical body. In the inside of the spherical body, a dispersion medium 21, a plurality of white particles (electrophoretic particles) 27, and a plurality of black particles (electrophoretic particles) 26 are enclosed. The microcapsules 20 are sandwiched between the common electrode 37 and the pixel electrodes 35 as shown in FIG. 3A, and one or more microcapsules 20 are arranged in one pixel 40.

The outer shell (wall membrane) of the microcapsule 20 is formed using a polymer resin with translucency, examples of which include acrylic resin, such as poly(methylmethacrylate) and poly(ethyl methacrylate), urea resin and gum Arabic.

The dispersion medium 21 is a liquid for dispersing the white particles 27 and black particles 26 in the microcapsule 20. Examples of the dispersion medium 21 can include water, alcoholic solvents (such as methanol, ethanol, isopropanol, butanol, octanol and methyl cellosolve), esters (such as ethyl acetate and butyl acetate), ketones (such as acetone, methyl ethyl ketone and methyl isobutyl ketone), aliphatic hydrocarbons (such as pentane, hexane and octane), alicyclic hydrocarbons (such as cyclohexane and methylcyclohexane), aromatic hydrocarbons (benzene, toluene, and benzenes having long-chain alkyl groups (such as xylene, hexylbenzene, heptylbenzene, octylbenzene, nonylbenzene, decylbenzene, undecylbenzene, dodecylbenzene, tridecylbenzene and tetradecylbenzene)), and carboxylic acid salts. Other oil substances may also be used. These substances may be used singly or as a mixture. Further, a surface active agent and the like may be contained in the substances.

The white particles 27 are particles (polymer or colloid) of white pigment, such as titanium dioxide, zinc oxide or antimony trioxide, and, for example, are used when they are negatively charged. The black particles 26 are particles (polymer or colloid) of black pigment, such as aniline black or carbon black, and, for example, are used when they are positively charged.

A charge control agent containing particles of an electrolyte, a surface active agent, metal soap, resin, rubber, oil, varnish or compound, a dispersing agent such as a titanium-based coupling agent, an aluminum-based coupling agent or a silane-based coupling agent, a lubricant, a stabilizing agent or the like may be added to the pigments as necessary.

In place of the black particles 26 and the white particle 27, for example, pigment of red, green, blue and the like may be used. Such a configuration allows red, green, blue and the like to be displayed on the display section 5.

Figure 4A:
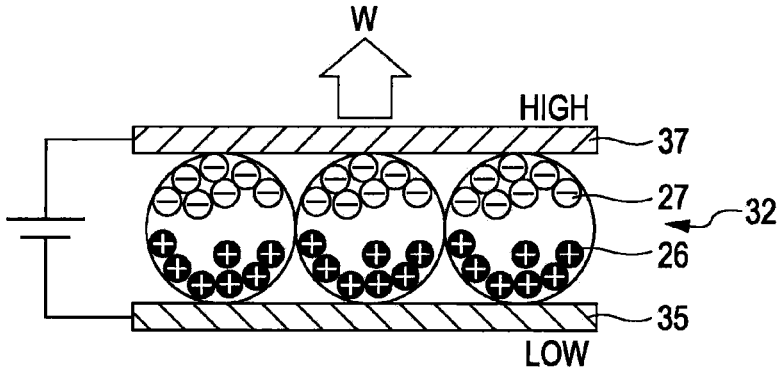
FIGS. 4A and 4B are explanatory views of the operation of an electrophoretic element.
Figure 4B:
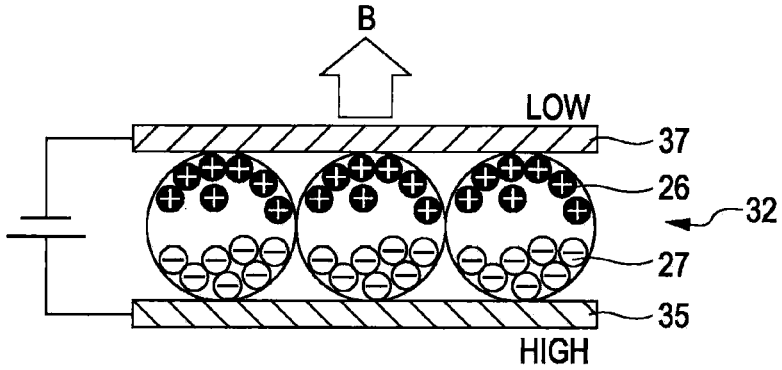

FIGS. 4A and 4B are explanatory views of the operation of an electrophoretic element. FIG. 4A shows the white display state of the pixel 40, and FIG. 4B shows the black display state of the pixel 40.

In the case of white display shown in FIG. 4A, the common electrode 37 is maintained at a relatively high potential whereas the pixel electrode 35 is maintained at a relatively low potential. As such, the negatively charged white particles 27 are pulled to the common electrode 37 whereas the positively charged black particles 26 are pulled to the pixel electrode 35. As a result, when this pixel is viewed from the side of the common electrode 37, which is the display surface side, white (W) is recognized.

In the case of black display shown in FIG. 4B, the common electrode 37 is maintained at a relatively low potential whereas the pixel electrode 35 is maintained at a relatively high potential. As such, the positively charged black particles 26 are pulled to the common electrode 37 whereas the negatively charged white particles 27 are pulled to the pixel electrode 35. As a result, when this pixel is viewed from the side of the common electrode 37, black (B) is recognized.

Driving Method

Next, with reference to FIGS. 5 to 7D, a method of driving an electrophoretic display device of this embodiment is described.

Figure 5:
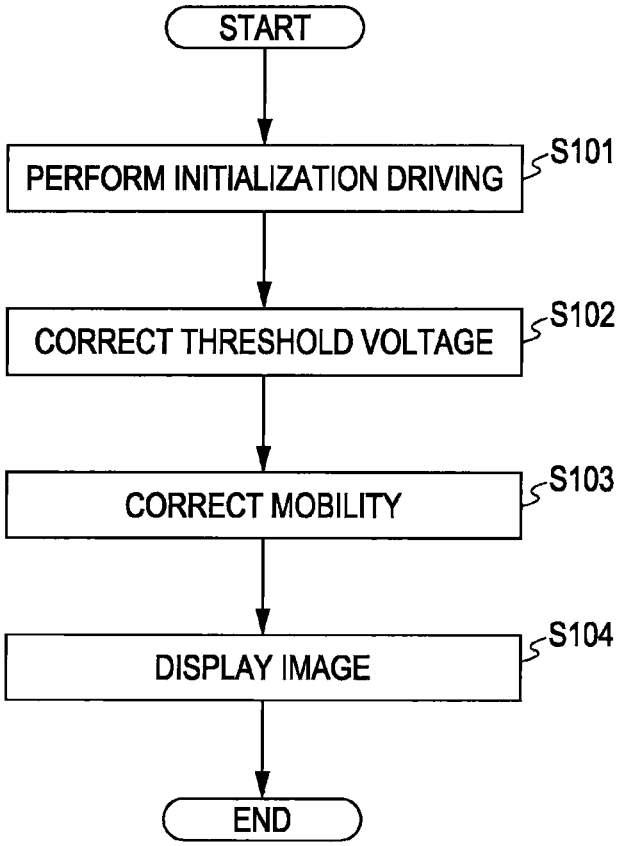
FIG. 5 is a flowchart showing a method of driving the electrophoretic display device according to the first embodiment.
Figure 6:
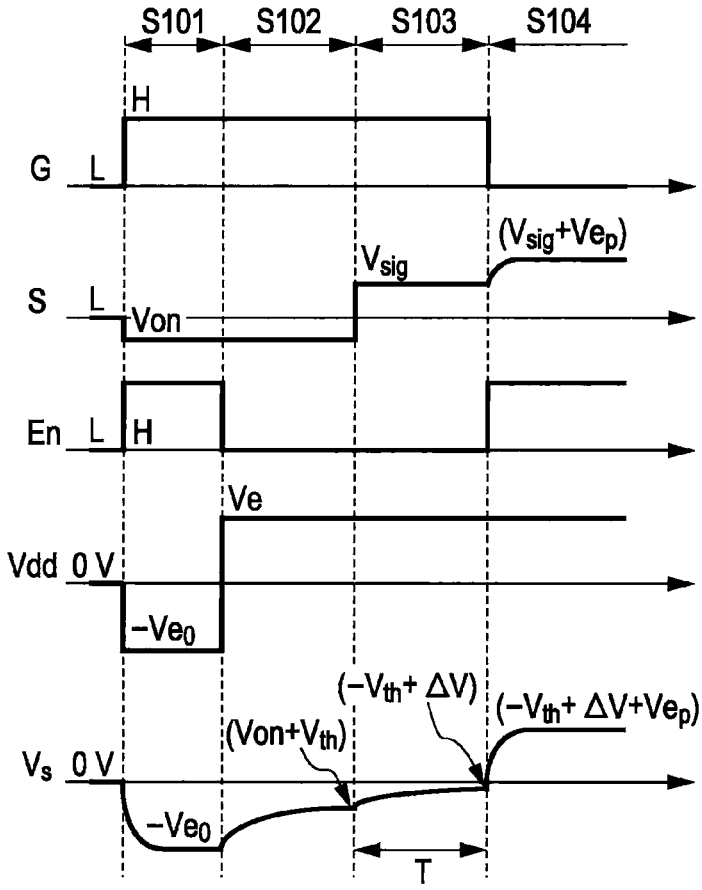
FIG. 6 is a timing chart corresponding to FIG. 5.

FIG. 5 is a flowchart showing a method of driving the electrophoretic display device 100. FIG. 6 is a timing chart corresponding to the flowchart of FIG. 5. FIGS. 7A to 7D are explanatory views of the action in the driving method of this embodiment.

As shown in FIG. 5, the driving method of this embodiment includes an initialization driving step S101, a threshold voltage correcting step S102, a mobility correcting step S103, and an image displaying step S104. In FIG. 6, a potential G of the scanning line 66, a potential S of the data line 68, a potential En of the enable line 49, a potential Vdd of the power supply line 50, and a potential $V_s$ of a node N2 (the source of the driving transistor TRd) are shown in correspondence to the above steps.

Note that, hereinafter, a description will be given of the case where a potential Vcom of the common electrode 37 is fixed to 0 V and a desired current is allowed to flow into the pixel electrode 35, so that an image is displayed. The case will be described on the assumption that the current characteristic of the driving transistor TRd is approximately given by the following equation (1):

$$I_s = \frac{1}{2}\frac{W}{L}C_{ox}\mu(V_g - V_s - V_{th})^2 = K(V_g - V_s - V_{th})^2 \quad (1)$$

$$K \equiv \frac{1}{2}\frac{W}{L}C_{ox}\mu$$

where:

W is the channel width;

L is the channel length;

$C_{ox}$ is a constant represented by the expression $\in_{ox}/t_{ox}$ ($\in_{ox}$: the dielectric constant of a gate oxide film, $t_{ox}$: the thickness of a gate insulating film);

μ is the mobility; and $V_{th}$ is the threshold voltage.

Initialization Driving Step

First, in the initialization driving step S101, high-level selection signals are input to scanning line 66 and the enable line 49 of each row to turn on the control transistor TRc and the enable transistor TRe. An image signal (potential Von) for turning on the driving transistor TRd is input to the data line 68 of each row, and the potential Vdd of the power supply line 50 is changed to a negative initialization voltage $-Ve_0$.

Figure 7A:
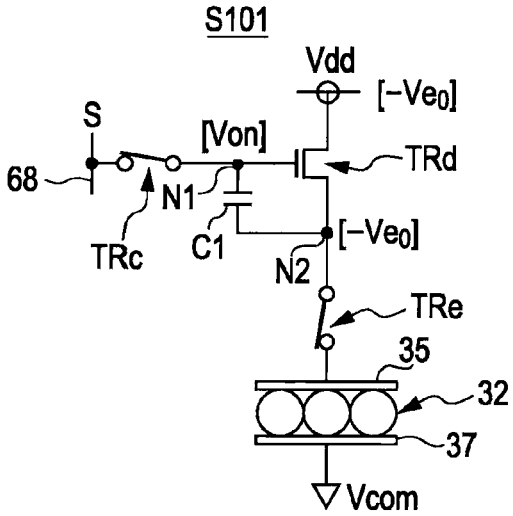
FIGS. 7A to 7D are explanatory views of the action in the driving method according to the first embodiment.

Then, as shown in FIG. 6 and FIG. 7A, through the driving transistor TRd in the on-state, the node N2 (source potential $V_s$) on the side of the pixel electrode 35 is set to a negative potential $-Ve_0$. This causes a gate-to-source voltage $V_{gs}$ of the driving transistor TRd to be forcedly set at a higher potential than the threshold voltage $V_{th}$ of the driving transistor (initialization of the driving transistor TRd).

At this point, since the enable transistor TRe is in the on-state, the negative initialization voltage $-Ve_0$ is input to the pixel electrode 35 through the driving transistor TRd and the enable transistor TRe. This causes the common electrode 37 (0 V) to be at a relatively high potential and causes the pixel electrode 35 to be at a relatively low potential, and thus white display is presented in the electrophoretic element 32 (see FIG. 4A).

Note that while white is displayed on the entire display section 5 in the initialization driving step S101 in this embodiment, the display state of the display section 5 may be prevented from being changed during execution of the initialization driving step S101. In this case, the enable transistor TRe may be turned off, or the common electrode 37 may be at the same potential ($-Ve_0$) as that of the power supply line 50.

Threshold Voltage Correcting Step

Next, in the threshold voltage correcting step S102, the threshold voltage $V_{th}$ of the driving transistor TRd will be corrected. The threshold voltage $V_{th}$ is the gate-to-source voltage $V_{gs}$ at which the source current of the driving transistor TRd starts to flow. The threshold voltage $V_{th}$ varies from one pixel 40 to another, which results in one of causes for display irregularities. This is, therefore, to be corrected in this step.

Figure 7B:
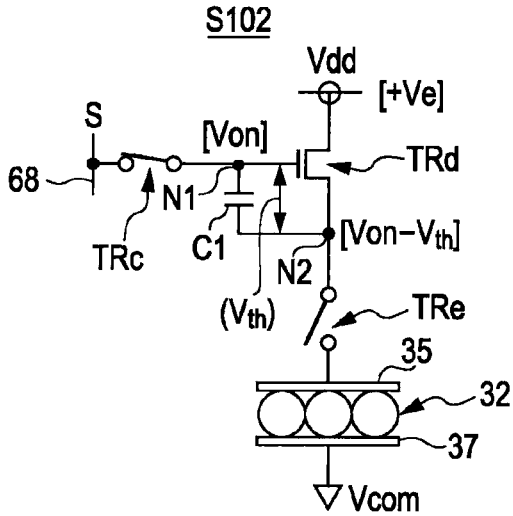

When the process goes to the threshold voltage correcting step S102, as shown in FIG. 6 and FIG. 7B, a low-level signal is input to the enable line 49 of each row to turn off the enable transistor TRe of every pixel 40. Thereafter, the potential Vdd of the power supply line 50 is set to a positive initialization voltage (Ve).

The gate-to-source voltage $V_{gs}$ of the driving transistor TRd has been set to be a higher voltage than the threshold voltage $V_{th}$ in the initialization driving step S101, and the on-state is held. Therefore, a current starts to flow from the power supply line 50 through the driving transistor TRd to the node N2 to start to charge the storage capacitor C1. The source potential $V_s$ increases as the charging operation proceeds. When the gate-to-source voltage $V_{gs}$ reaches the threshold voltage $V_{th}$, the driving transistor TRd turns off, and thus the current stops flowing. The potential of each node at this point is as shown in FIG. 7B.

In the above state where the current stops, the voltage across the storage capacitor C1 is equal to the threshold voltage $V_{th}$ of the driving transistor TRd. Thus, correction of the threshold voltage of the driving transistor TRd is completed.

The important point for the above-described threshold voltage correcting step S102 is that the enable transistor TRe is held in the off-state during the threshold voltage correcting step S102. The electrophoretic element 32 has a capacitive component and a resistive component in parallel, and a current easily flows through the electrophoretic element 32 if there is a potential difference between the pixel electrode 35 and the common electrode 37. When the current flows through the electrophoretic element 32, electric charges of the node N2 are transferred both to the capacitor C1 and to the pixel electrode 35. This makes it impossible to accurately correct the threshold voltage at which the current of the driving transistor TRd is zero. To overcome this impossibility, the enable transistor TRe is provided to enable the driving transistor TRd and the pixel electrode 35 to be electrically disconnected.

Mobility Correcting Step

Figure 7C:
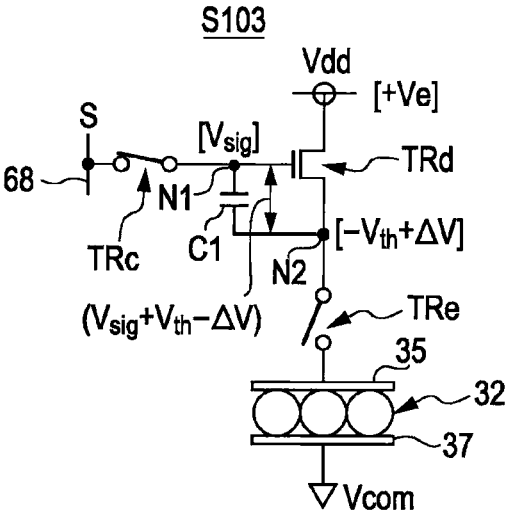

In the mobility correcting step S103, as shown in FIG. 6 and FIG. 7C, an image signal of the voltage $V_{sig}$ in accordance with a display gradation is input to the data line 68 to turn on the control transistor TRc and turn off the enable transistor TRe, and their states are kept for a preset correcting operation time period T. This enables the mobility, etc. of the driving transistor TRd to be corrected so as to achieve constant-current driving in the subsequent image displaying step S104.

The action in which the mobility, etc. of the driving transistor TRd is corrected by the above-mentioned operation will be described below.

First, assuming that the current $I_s$ [$V_{gs}$] in the saturation region of the driving transistor TRd is expressed by equation (2) given below, the variation $V_s$[t] in time of the source voltage (node N2) whose threshold voltage has been corrected is obtained as equation (4) by solving the differential equation of equation (3) given below. However, $v_0$ in equations (3) and (4) is unified as $v_o = V_g - V_{th}$. Since the enable transistor TRe is in the off-state, the initial value is given as $v_s[0]=0$ for the sake of simplification.

$$I_s[V_{gs}] = K(V_g - V_s - V_{th})^2 \quad (2)$$

$$V_s'[t] = \frac{K(v_0 - v_s[t])^2}{c_L} \quad (3)$$

$$V_s[t] = \frac{Ktv_0^2}{c_L + Ktv_0} \quad (4)$$

Further, substituting equation (4) into equation (2) yields equation (5) given below.

$$I_s[t] = K\left(\frac{c_L v_0}{c_L + Ktv_0}\right)^2 = K\left(\frac{v_0}{1 + \frac{Ktv_0}{c_L}}\right)^2 \quad (5)$$

Here, time t=T that satisfies equation (6) given below is set to transform equation (6) into equation (7). Substituting equation (7) into equation (5) yields equation (8) given below.

$$c_L = KTv_0 \quad (6)$$

$$t = T = \frac{c_L}{Kv_0} \quad (7)$$

$$I_s[T] = K\left(\frac{v_0}{1 + \frac{Ktv_0}{c_L}}\right)^2 = K\left(\frac{v_0}{1+1}\right)^2 = K \times \frac{v_0^2}{4} \quad (8)$$

Further, when equation (9) given below is substituted into equation (8), terms of K are eliminated as shown in equation (10). K is a constant determined for every transistor as shown in equation (11).

$$v_0^2 = v_0 \times \frac{c_L}{KT} \quad (9)$$

$$I_s[T] = K \times \frac{v_0^2}{4} = \cancel{K} \times \frac{v_0 \times \frac{c_L}{\cancel{K}T}}{4} = \frac{v_0 c_L}{4T} \quad (10)$$

$$K = \frac{1}{2}\frac{W}{L}C_{ox}\mu \quad (11)$$

As is seen from equations (10) and (11), even when the gate width W, the gate length L, the characteristic $C_{ox}$ of the gate insulating film, and the mobility μ vary from the driving transistor TRd of one pixel 40 to that of another, current flowing through the driving transistor TRd in each pixel 40 can be made uniform by appropriately selecting the correcting operation time period T.

Note that, strictly speaking, the time t=T satisfying $c_L=KTv_o$ set in equation (6) is set on the basis of K of one driving transistor TRd. Therefore, the correcting operation time period T calculated from equation (6) is not necessarily the optimum value for another driving transistor TRd.

To address this issue, the current value of another driving transistor TRd is calculated with an error of K taken into account. A constant K' of the driving transistor TRd to be calculated can be represented using K and Δ∈ as shown in equation (12) given below. Calculating the current of another driving transistor TRd using K' gives equation (13). Therefore, in cases where the error Δ∈ of K is 20%, $\Delta\in^2/4=(0.2)^2/4=0.01$, which indicates that the current error is reduced up to 1%. Accordingly, when the correcting operation time period T is appropriately set, the mobility of the driving transistors TRd of the whole display section 5 can be corrected.

$$K' = K'(1+\varepsilon) \quad (12)$$

$$I_s[T] = \frac{1+\Delta\varepsilon}{(2+\Delta\varepsilon)^2}\frac{v_0 c_L}{T} \approx \left(\frac{1}{4} - \frac{\Delta\varepsilon^2}{16}\right) \times \frac{v_0 c_L}{T} = \frac{v_0 c_L}{4T} \times \left(1 - \frac{\Delta\varepsilon^2}{4}\right) \quad (13)$$

Note that the result of correction of the mobility in the above-described mobility correcting step S103 is reflected in the voltage across the storage capacitor C1 as shown in FIG. 6 and FIG. 7C. That is, the node N1 (gate potential $V_g$) is at the potential $V_{sig}$ of the data line 68, whereas the node N2 is at a potential $-V_{th}+\Delta V$ resulting from addition of the corrected voltage difference ΔV. The voltage difference ΔV is a value that varies in accordance with the mobility μ of the driving transistor TRd. More particularly, the potential difference ΔV is relatively large in the driving transistor TRd in which the mobility μ is large, and ΔV is relatively small in the driving transistor TRd in which the mobility μ is small. Thus, the driving transistor TRd when the correcting operation time period T has passed is corrected to the state where the current $I_s$, which is constant, flows regardless of the mobility μ.

The correcting operation time period T may be experimentally set as a time period for minimizing display irregularities in the display section 5. Specifically, since the correcting operation time period T can be adjusted using a period in which the scanning line 66 is at the high-level, the correcting operation time period T can be experimentally set by observing display irregularities under a condition where the pulse width of the selection signal input to the scanning line 66 varies.

Maintaining the off-state of the enable transistor TRe is important also in the mobility correcting step S103. This is because current flow into the electrophoretic element 32 makes it impossible to accurately correct the mobility.

Image Displaying Step

When the above-described threshold voltage correcting and mobility correcting has finished, the process goes to the image displaying step S104.

Figure 7D:
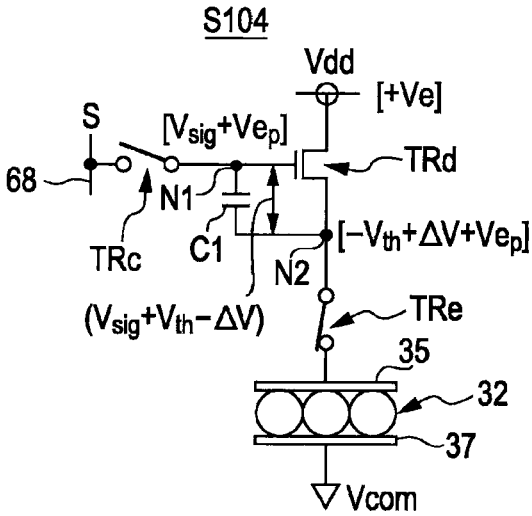

In the image displaying step S104, as shown in FIG. 6 and FIG. 7D, a selection signal (low level) for turning off the control transistor TRc is input to the scanning line 66 of each row. Then, the node N1 enters the high-impedance state to fix the voltage difference across the storage capacitor C1. As a result, the driving transistor TRd functions as a constant current source. When transition of the potential En of the enable line 49 to the high level is made under this condition, the enable transistor TRe is turned on to cause a constant current from the driving transistor TRd to flow to the pixel electrode 35. Thus, the electrophoretic element 32 is driven, and therefore charged particles in the electrophoretic element 32 move. This results in display of a black image component, for example, on a white background set in the initialization driving step S101.

Note that, in order to fix the pixel 40 to a desired gradation, when the electrophoretic element 32 reaches a given gradation, the image signal may be input again through the control transistor TRc to reset the voltage across the storage capacitor C1 so as to stop the current of the driving transistor TRd.

Alternatively, more simply, the potential En (low level) for turning off the enable transistor TRe may be input to the enable line 49.

As described in detail above, according to the method of driving an electrophoretic display device of this embodiment, execution of the steps from the initialization driving step S101 to the image displaying step S104 allows a desired image to be displayed on the display section 5 with the threshold voltage and the mobility of the driving transistor TRd of each pixel 40 corrected. Uniform image display without irregularities can thus be obtained.

Second Embodiment

Next, a second embodiment of the invention is described with reference to FIGS. 8 and 9.

In an electrophoretic display device 200 of this embodiment, an enable line control circuit is added to the electrophoretic display device 100 of the previous embodiment that has been described with reference to FIGS. 1 to 7D.

Figure 8:
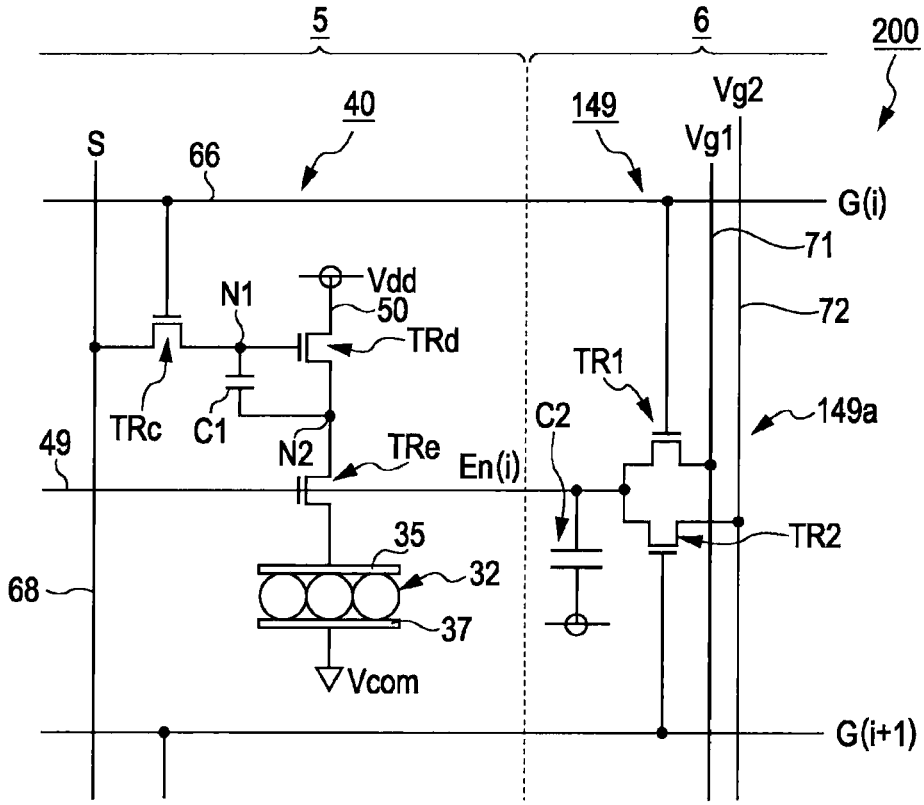
FIG. 8 is a schematic block diagram of an electrophoretic display device according to a second embodiment.

FIG. 8 is a schematic block diagram of the display section 5 and a non-display section 6 of the electrophoretic display device 200 of this embodiment.

As shown in FIG. 8, the pixel 40 is formed in the display section 5 of the electrophoretic display device 200, and an enable line control circuit 149 is provided in the non-display section 6 outside the display section 5.

The enable line control circuit 149 includes switch circuits 149*a* that are provided so as to correspond to the respective enable lines 49 extending along the scanning lines 66. Each switch circuit 149*a* is connected to a first power supply line 71 and a second power supply line 72. The switch circuit 149*a* corresponding to an i-th row ($1 \leq i \leq m$) enable line 49 is connected to the i-th row enable line 49 and is connected to an i-th row scanning line 66 and to the subsequent (i+1)-th row scanning line 66.

The switch circuit 149*a* includes a first transistor TR1, a second transistor TR2 and a capacitor C2.

The gate of the first transistor TR1 is connected to the i-th row scanning line 66, its source is connected to the first power supply line 71, and its drain is connected to the i-th row enable line 49. The gate of the second transistor TR2 is connected to the (i+1)-th row scanning line 66, its source is connected to the second power supply line 72, and its drain is connected to the i-th row enable line 49. In the capacitor C2, one electrode is connected to the i-th row enable line 49, and the other electrode is connected to the ground or a power supply at an arbitrary potential.

In the switch circuit 149*a* having the above-described configuration, electrical connection between the first power supply line 71 and the enable line 49 can be switched by inputting a selection signal through the i-th row scanning line 66 to the first transistor TR1, and electrical connection between the second power supply line 72 and the enable line 49 can be switched by inputting a selection signal through the (i+1)-th row scanning line 66 to the second transistor TR2.

Note that, while the gate of the second transistor TR2 is connected to the (i+1)-th row scanning line 66 in this embodiment, the gate may be connected to the scanning line 66 in any row other than the i-th row.

While the switch circuit 149*a* is formed to the right of the display section 5 in FIG. 8 referred to in this embodiment, the switch circuit 149*a* may be connected to an end on the opposite side of the enable line 49. That is, the switch circuits 149*a* may be placed along only one side of the display section 5, and may also be arranged along two facing sides of the display section 5. In the latter case, the placement positions of the switch circuits 149*a* may be divided such that they vary between different ends of the enable line 49 (to the left and right of the display section 5) from one row to another.

In the image displaying operation in the electrophoretic display device 200 having the above-described configuration, rectangular pulses synchronized with the operation of selecting the scanning line 66 are supplied to the first power supply line 71 and the second power supply line 72 of the enable line control circuit 149. By the operation of the switch circuit 149*a* on the basis of a selection signal (the potential G) input through the scanning line 66, a controlled potential is supplied to the enable line 49. Hereinafter, the operation in each step will be specifically described with reference to FIG. 9.

Figure 9:
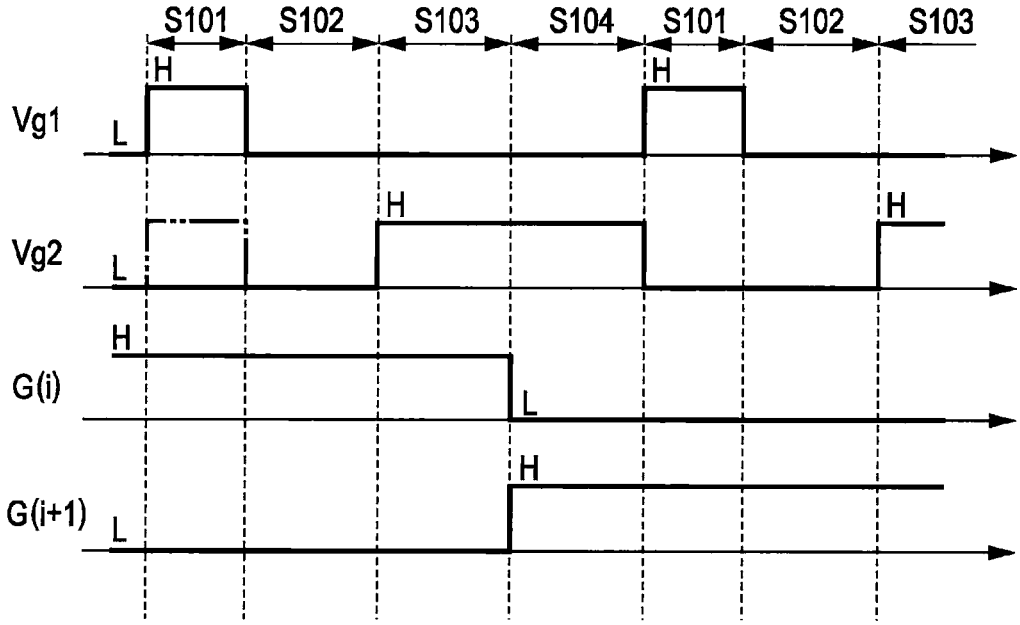
FIG. 9 is a timing chart for explaining the operation of an enable line control circuit.

FIG. 9 is a timing chart for explaining the operation of the enable line control circuit 149. Shown in FIG. 9 are a potential Vg1 of the first power supply line 71, a potential Vg2 of the second power supply line 72, a potential G(i) of the i-th row scanning line 66, and a potential G(i+1) of the (i+1)-th row scanning line 66.

First, in the initialization driving step S101, as shown in FIG. 9, at least the potential Vg1 of the first power supply line 71 is set to a potential (high-level) for turning on the enable transistor TRe. As a result, when the i-th row scanning line 66 is selected to turn on the first transistor TR1, the enable transistor TRe is turned on, which allows a current from the driving transistor TRd to flow into the pixel electrode 35 to drive the electrophoretic element 32.

Note that, in the case of selecting scanning line 66 on a row-by-row basis in the initialization driving step S101, the potential Vg2 of the second power supply line 72 can be set to any potential. On the other hand, in the case of simultaneously selecting a plurality of scanning lines 66 and simultaneously performing initializing operation of the pixels 40 belonging to the plurality of scanning lines 66, a potential (high-level) for turning on the enable transistor TRe is supplied to the second power supply line 72 as indicated by a chain double-dashed line in FIG. 9. This is because when selection signals are simultaneously input to the plurality of scanning lines 66, the first transistor TR1 and the second transistor TR2 might be simultaneously turned on in some cases, and therefore it is intended to prevent the potential of the first power supply line 71 and the potential of the second power supply line 72 from colliding with each other in such cases.

Next, in the threshold voltage correcting step S102, at least the potential Vg1 of the first power supply line 71 is set to a potential (low level) for turning off the enable transistor TRe. This allows the enable transistor TR in the on-state in the initialization driving step S101 to be changed to the off-state, which can prevent a current from flowing into the pixel electrode 35. The threshold voltage correcting can thus be accurately performed.

Note that inputting the potential for turning off the enable transistor TRe also to the second power supply line 72 in the case of simultaneously selecting a plurality of scanning lines 66 and performing the threshold voltage correcting is similar to that in the initialization driving step S101.

Then, in the mobility correcting step S103 and the image displaying step S104, the potential Vg1 of the first power supply line 71 is set to the potential (low level) for turning off the enable transistor TRe, whereas the potential Vg2 of the second power supply line 72 is set to the potential (high-level) for turning on the enable transistor TRe.

Here, as shown in FIG. 9, periods in which a selection signal is input through the scanning line 66 (periods in which the control transistor TRc is turned on) are periods from the initialization driving step S101 to the mobility correcting step S103. The process of the pixel 40 belonging to the i-th row scanning line 66 goes to the image displaying step S104, which initiates the input of the potential (high-level) for turning on the control transistor TRc to the (i+1)-th row scanning line 66.

Inputting potentials to the first power supply line 71 and the second power supply line 72 as mentioned above makes it possible to turn off the enable transistor TRe in the mobility correcting step S103 for the pixel 40 belonging to the i-th row scanning line 66. This can prevent a current from flowing into the pixel electrode 35, and, as a result, the mobility correcting can be accurately performed. Then, the process of the pixel 40 belonging to the i-th row scanning line 66 goes to the image displaying step S104. In this step, the potential G(i+1) of the (i+1)-th row scanning line 66 is set to the potential (high-level) for turning on the second transistor TR2. The potential (high-level) for turning on the enable transistor TRe is therefore input through the second transistor TR2 to the enable line 49. This results in image displaying in the pixel 40 belonging to the i-th row scanning line 66.

Further, when the subsequent (i+2)-th row scanning line 66 is selected, both the first transistor TR1 and the second transistor TR2 are turned off. However, since the capacitor C2 is connected to the enable line 49, the enable line 49 is maintained to the potential for turning on the enable transistor TRe by the capacitor C2. Thus, the driving state of the electrophoretic element 32 is kept for a given period after the completion of the image displaying step S104.

As described in detail above, with the electrophoretic display device 200 according to the second embodiment, providing the enable line control circuit 149 eliminates the need for providing in the outside a drive circuit for controlling the potential of the enable line 49. In this respect, while no external drive circuit is required when the common power supply modulation circuit 64 is formed on the element substrate 30 in the first embodiment, only the first power supply line 71 and the second power supply line 72 are included in global wiring related to driving the enable line 49 in this embodiment. Therefore, the circuit configuration of the common power supply modulation circuit 64 and the layout of wiring on the substrate can be simplified.

Modification

A modification of the second embodiment is described with reference to FIG. 10.

An electrophoretic display device 200A according to this modification is obtained by changing the configuration of the enable line control circuit of the electrophoretic display device 200 in the second embodiment that has been described with reference to FIG. 8 and FIG. 9.

Figure 10:
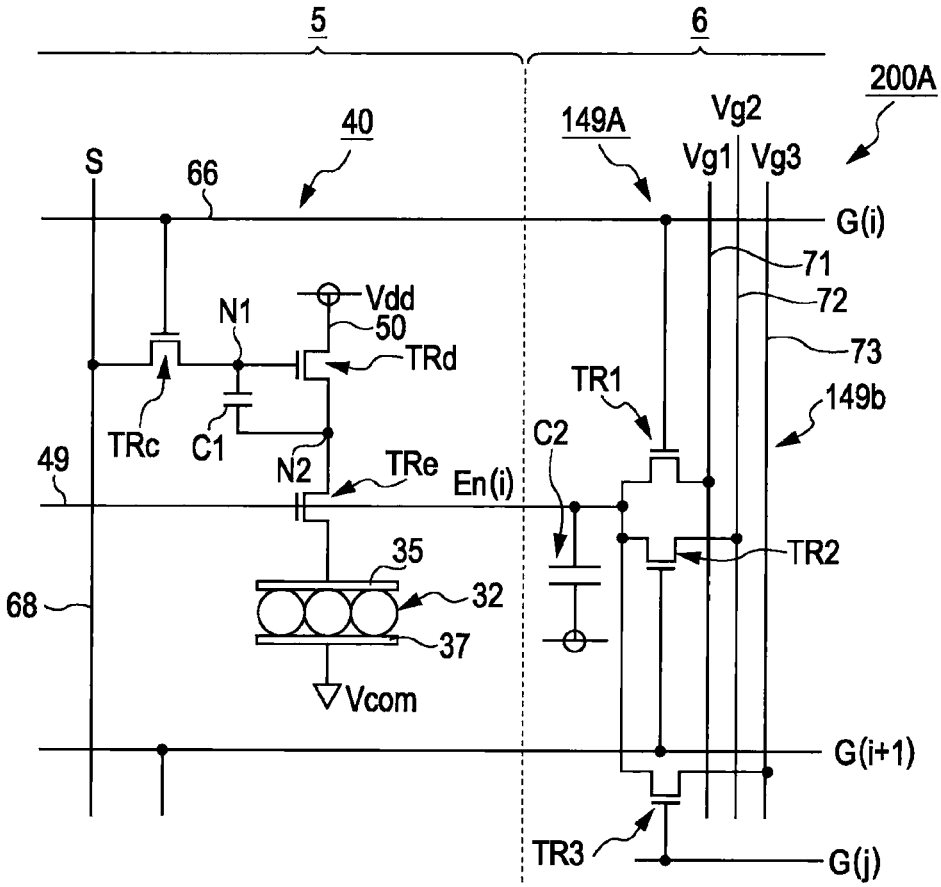
FIG. 10 is a schematic block diagram of an electrophoretic display device according to a modification of the second embodiment.

As shown in FIG. 10, in the electrophoretic display device 200A, an enable line control circuit 149A is included in the non-display section 6.

The enable line control circuit 149A includes a plurality of switch circuits 149*b*, the first power supply line 71, the second power supply line 72 and a third power supply line 73. The switch circuits 149*b* are provided so as to correspond to the respective enable lines 49. The switch circuit 149*b* connected to the i-th row ($1 \le i \le m$) enable line 49 is connected to the i-th row scanning line 66 and to the subsequent (i+1) row scanning line 66, and a j-th row ($j \ne i, i+1, 1 \le j \le m$) scanning line 66, which is different from both the i-th row scanning line 66 and the (i+1)-th row scanning line 66.

More particularly, the switch circuit 149*b* includes the first transistor TR1, the second transistor TR2, a third transistor TR3 and the capacitor C2.

The gate of the first transistor TR1 is connected to the i-th row scanning line 66, its source is connected to the first power supply line 71, and its drain is connected to the i-th row enable line 49. The gate of the second transistor TR2 is connected to the (i+1)-th row scanning line 66, its source is connected to the second power supply line 72, and its drain is connected to the i-th row enable line 49. The gate of the third transistor TR3 is connected to the (i+1)-th row scanning line 66, its source is connected to the third power supply line 73, and its drain is connected to the i-th row enable line 49. In the capacitor C2, one electrode is connected to the i-th row enable line 49, and the other electrode is connected to the ground or a power supply at an arbitrary potential.

That is, the switch circuit 149*b* is a circuit selectively connecting the first power supply line 71, the second power supply line 72 and the third power supply line 73 to the enable line 49, and the switching operation is controlled by a selection signal input through the i-th row, (i+1)-th row and j-th row scanning lines 66.

In the electrophoretic display device 200A according to the modification having the above-described configuration, inclusion of the third transistor TR3 and the third power supply line 73 allows the enable transistor TRe to be controlled more finely. Various driving modes can thus be easily performed. A detailed description will be given below.

The operation of the first transistor TR1 and the second transistor TR2 in the electrophoretic display device 200A is similar to that in the second embodiment. In the image displaying step S104, the second transistor TR2 is turned on to start the image displaying operation. After the second transistor TR2 is changed to the off-state, the on-state of the enable transistor TRe is kept by charges held in the capacitor C2.

In this modification, during a period in which the enable transistor TRe is maintained to the on-state by the capacitor C2, the enable transistor TRe can be controlled still more finely by the operation of the third transistor TR3. For example, in cases where the potential (low level) for turning off the enable transistor TRe has been supplied to the third power supply line 73, when the third transistor TR3 is turned on as a result of selection of the j-th row scanning line 66, the enable transistor TRe can be changed to the off-state to stop driving the electrophoretic element 32. That is, the period in which the electrophoretic element 32 is driven can be strictly controlled regardless of the amount of charges of the capacitor C2.

On the other hand, in cases where the potential (high level) for turning on the enable transistor TRe has been supplied to the third power supply line 73, when the j-th row scanning line 66 is selected, the capacitor C2 can be recharged. This allows driving of the electrophoretic element 32 to be continued for a longer period.

Regarding the electrophoretic display device 200A according to the above-described modification, the case where the gate of the third transistor TR3 is connected to the j-th row scanning line 66 has been described. However, the device may be configured such that external control lines are connected to the gates of all the third transistors TR3 to allow the third transistors TR3 to be controlled independently from the operation of selecting the scanning line 66.

In such a configuration, when the potential (high-level) for turning on the third transistor TR3 is input to the above-mentioned control line in a state where the potential (low level) for turning off the enable transistor TRe is supplied to the third power supply line 73, the enable transistors TRe can be turned off at once in all the pixels 40 of the display section 5, and thus driving of the electrophoretic elements 32 of all the pixels 40 can be stopped.

Third Embodiment

Next, a third embodiment of the invention is described with reference to FIG. 11.

In an electrophoretic display device 300 of this embodiment, a potential control circuit is added to the electrophoretic display device 100 of the first embodiment that has been described with reference to FIGS. 1 to 7D.

Figure 11:
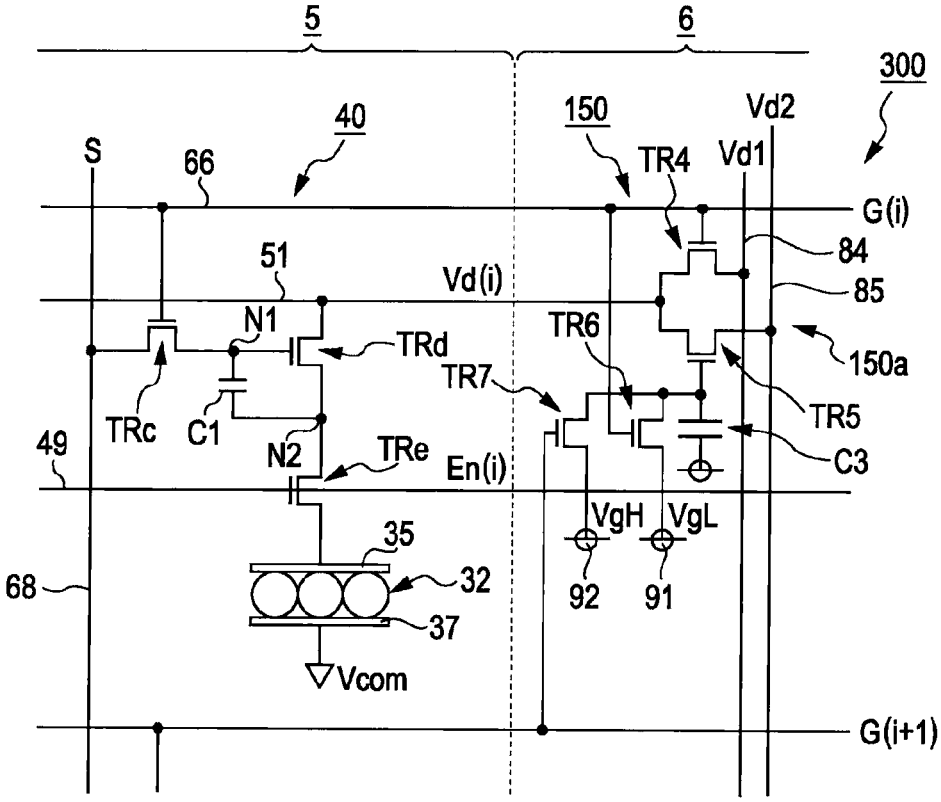
FIG. 11 is a schematic block diagram of an electrophoretic display device according to a third embodiment.

FIG. 11 is a schematic block diagram showing the display section 5 and the non-display section 6 of the electrophoretic display device 300 of the third embodiment.

As shown in FIG. 11, power supply lines 51 corresponding to the respective scanning lines 66, in place of the power supply lines 50 shown in FIG. 1, are formed in the display section 5 of the electrophoretic display device 300. Each power supply line 51 extends along the corresponding scanning line 66. On the other hand, provided in the non-display section 6 outside the display section 5 is a potential control circuit 150. The potential control circuit 150 includes a plurality of switch circuits 150*a*, a fourth power supply line 84 and a fifth power supply line 85.

The switch circuits 150*a* are provided so as to correspond to the respective power supply lines 51 extending along the scanning lines 66. The switch circuit 149*a* corresponding to an i-th row ($1 \leq i \leq m$) power supply line 51 is connected to the i-th row power supply line 51 and is connected to the i-th row scanning line 66, the subsequent (i+1)-th row scanning line 66, a low potential power supply 91 (first power supply; potential VgL) and a high potential power supply 92 (second power supply; potential VgH).

The switch circuit 150*a* includes a fourth transistor TR4, a fifth transistor TR5, a sixth transistor TR6, a seventh transistor TR7 and a capacitor C3.

The gate of the fourth transistor TR4 is connected to the i-th row scanning line 66, its source is connected to the fourth power supply line 84, and its drain is connected to the i-th row power supply line 51.

The gate of the fifth transistor TR5 is connected to the drain of the sixth transistor TR6 and the drain of the seventh transistor TR7, and is connected to one electrode of the capacitor C3. The source of the fifth transistor TR5 is connected to the fifth power supply line 85, and its drain is connected to the i-th row power supply line 51.

The gate of the sixth transistor TR6 is connected to the i-th row scanning line 66, its source is connected to the low potential power supply 91, and its drain is connected to the gate of the fifth transistor TR5.

The gate of the seventh transistor TR7 is connected to the (i+1)-th row scanning line 66, its source is connected to the high potential power supply 92, and its drain is connected to the gate of the fifth transistor TR5.

In the capacitor C3, one electrode is connected to the gate of the fifth transistor TR5, and the other electrode is connected to the ground or a power supply at an arbitrary potential.

In the switch circuit 150*a* having the above-described configuration, electrical connection of the fourth power supply line 84 and the fifth power supply line 85 to the power supply line 51 is switched using the fourth transistor TR4 and the fifth transistor TR5.

The fourth transistor TR4 is controlled by a selection signal input through the i-th row scanning line 66. On the other hand, the fifth transistor TR5 is controlled by using a potential output from a circuit including the sixth transistor TR6, the seventh transistor TR7 and the capacitor C3. Specifically, the sixth transistor TR6 outputs the potential VgL (low level) for turning on the fifth transistor TR5, and the seventh transistor TR7 outputs the potential VgH (high-level) for turning on the fifth transistor TR5. The capacitor C3 maintains the output potential from the sixth transistor TR6 or the seventh transistor TR7 for a given period.

Note that, while the gate of the seventh transistor TR7 is connected to the (i+1)-th row scanning line 66 in this embodiment, the gate may be connected to the scanning line 66 in any row other than the i-th row.

While the switch circuit 150*a* is formed to the right of the display section 5 in FIG. 11 referred to in this embodiment, the switch circuit 150*a* may be connected to an end on the opposite side of the power supply line 51. That is, the switch circuits 150*a* may be placed along only one side of the display section 5, and may also be arranged along two facing sides of the display section 5. In the latter case, the placement positions of the switch circuits 150*a* may be divided such that they vary between different ends of the power supply line 51 (to the left and right of the display section 5) from one row to another.

An example of the image displaying operation in the electrophoretic display device 300 in the above-described configuration is described below.

Figure 12:
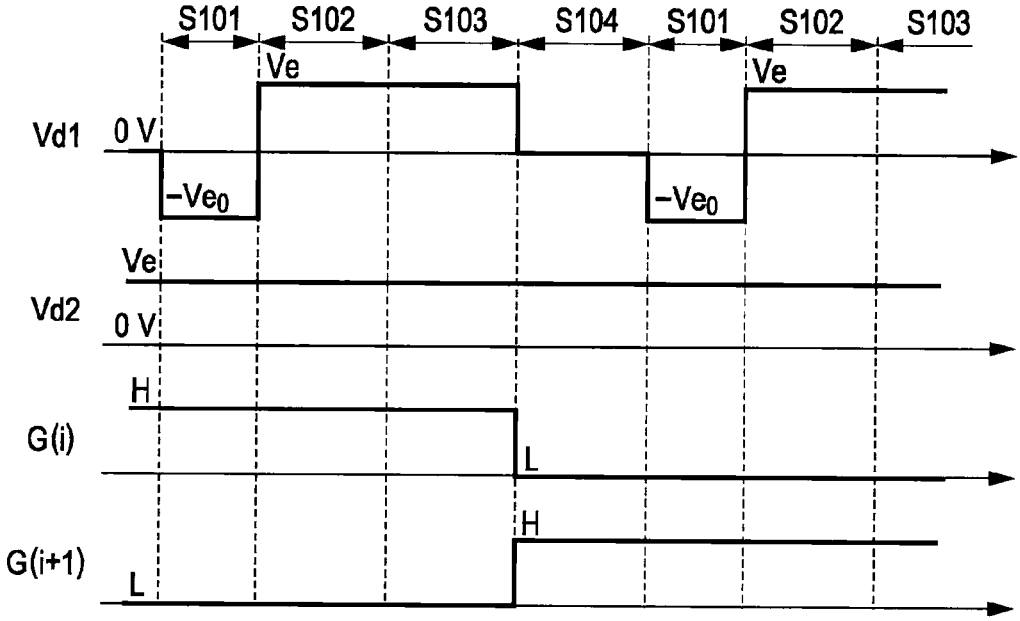
FIG. 12 is a timing chart for explaining the operation of a potential control circuit.

FIG. 12 is a timing chart for explaining the operation of the potential control circuit 150, and Table 1 describes the on/off states of transistors and the potential of the power supply line 51 in each step of the image displaying operation.

TABLE 1

| | S101 | S102 | S103 | S104 |
|---|---|---|---|---|
| TR4 | on | on | on | off |
| TR5 | off | off | off | on |
| TR6 | on | on | on | off |
| TR7 | off | off | off | on |
| Vd(i) | Vd1 ($-Ve_0$) | Vd1 (+Ve) | Vd1 (+Ve) | Vd2 (+Ve) |

As shown in FIG. 12, rectangular pulses synchronized with the operation of selecting the scanning line 66 are input to the fourth power supply line 84 (potential Vd1), and the fifth power supply line 85 (potential Vd2) is maintained to a potential Ve for image displaying.

First, in the initialization driving step S101, the potential (high-level) for turning on the enable transistor TRe is input to the i-th row scanning line 66 in the state where a negative potential $-Ve_0$ is supplied to the fourth power supply line 84, and this selection signal turns on the fourth transistor TR4 and the sixth transistor TR6. As a result, the power supply line 51 and the fourth power supply line 84 are connected to each other through the fourth transistor TR4 to cause the power supply line 51 to be at the negative potential $-Ve_0$. Then, the negative potential $-Ve_0$ is supplied to the drain of the driving transistor TRd to perform the processing of the initialization driving step S101.

On the other hand, the potential VgL is input from the sixth transistor TR6 to the gate of the fifth transistor TR5, and therefore the fifth transistor TR5 is maintained to the off-state. Accordingly, no collision of voltages will occur in the power supply line 51.

Next, the process goes to the threshold voltage correcting step S102. In this step, the positive potential Ve is supplied to the fourth power supply line 84. On the other hand, the on/off states of the fourth transistor TR4 and the fifth transistor TR5 do not change, and therefore the positive potential Ve is supplied from the fourth power supply line 84 to the power supply line 51. Under this condition, the processing of the threshold voltage correcting step S102 and the processing of the mobility correcting step S103 are performed.

Thereafter, the process goes to the image displaying step S104. In this step, the i-th row scanning line 66 is set to an unselected state (low level) and the (i+1)-th row scanning line 66 is set to a selected state (high level). As a result, as shown in Table 1, the fourth transistor TR4 and the sixth transistor TR6 are turned off. The seventh transistor TR7 whose gate is connected to the (i+1)-th row scanning line 66 is turned on. This causes the fifth transistor TR5 to be turned on to connect the fifth power supply line 85 with the power supply line 51. Through the power supply line 51, the potential (potential Ve) of the fifth power supply line 85 is supplied to the drain of the driving transistor TRd of the pixel 40. Under this condition, the processing of the image displaying step S104 of the pixel 40 belonging to the i-th row scanning line 66 is performed.

Note that when the (i+1)-th row scanning line 66 is changed to the unselected state (low level), the seventh transistor TR7 is turned off. However, the gate potential of the fifth transistor TR5 is kept by using the capacitor C3. The fifth transistor TR5 is therefore maintained to the on-state, and thus the potential Ve continues to be supplied to the power supply line 51 from the fifth power supply line 85.

As described in detail above, in the electrophoretic display device 300 of the third embodiment, inclusion of the potential control circuit 150 allows the power supply line 51 in each row to be controlled in synchronization with the operation of selecting the scanning line 66.

In cases where the initialization driving step S101 and the threshold voltage correcting step S102 are performed for each row, a drive circuit to control the drain potential of the driving transistor TRd needs to be provided for each row. However, such a drive circuit is not necessary in this embodiment.

Note that it is to be understood that, in the above-described third embodiment, the enable line control circuit 149 or 149A similar to that in the second embodiment may be provided and configured to control the potential that is supplied to the enable line 49 in accordance with the operation of selecting the scanning line 66.

Electronic Device

Next, cases where the electrophoretic display devices 100, 200, 200A and 300 of the above-described embodiments are applied to an electronic device are described.

Figure 13:
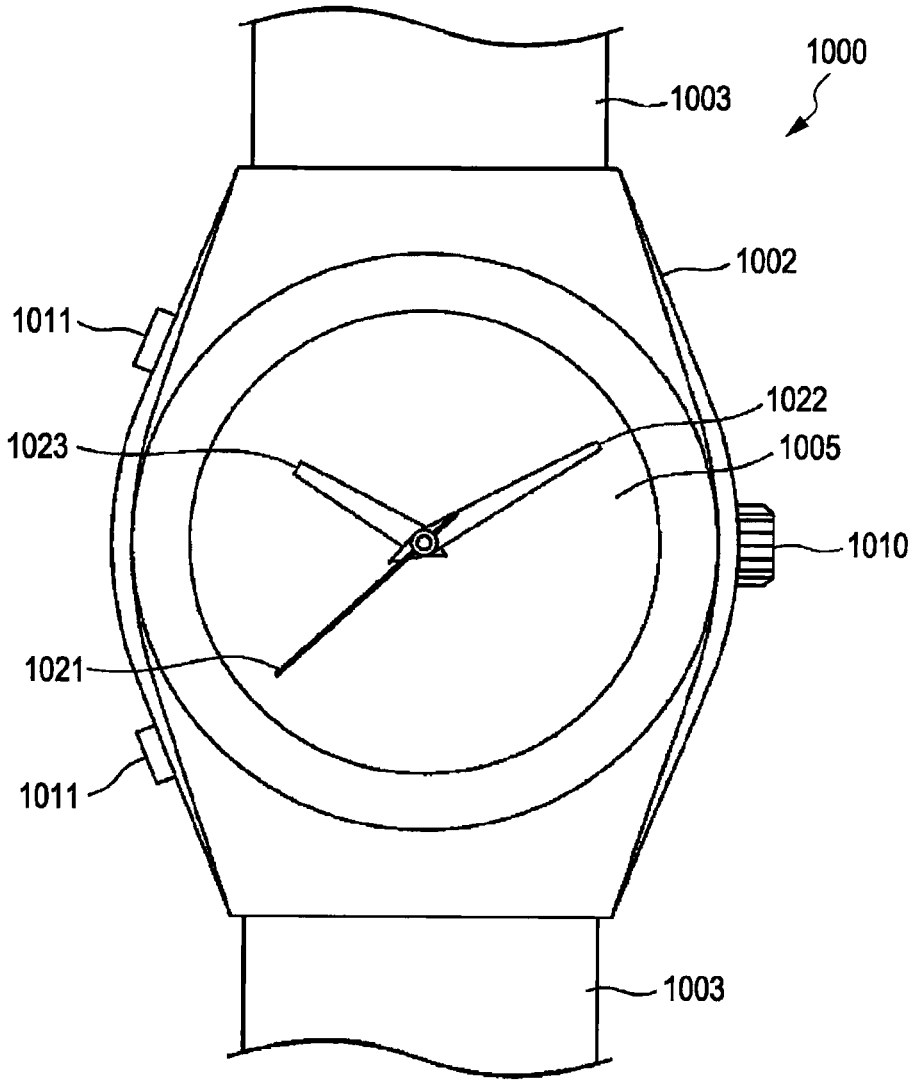
FIG. 13 shows an exemplary electronic device.

FIG. 13 is a front view of a wristwatch 1000. The wristwatch 1000 includes a watchcase 1002 and a pair of bands 1003 coupled to the watchcase 1002.

The front face of the watchcase 1002 is provided with a display section 1005 made of the electrophoretic display device of one of the above-described embodiments, a second hand 1021, a minute hand 1022 and an hour hand 1023. The side face of the watchcase 1002 is provided with a winding crown 1010 as an operation member, and operation buttons 1011. The winding crown 1010 is coupled to a winding stem (not shown) provided inside the case. The winding crown 1010 united with the winding stem is provided so as to be freely pushed and pulled in multiple steps (e.g., two steps) and to be freely rotatable. On the display section 1005, an image serving as the background, character strings representing a date and time, second, minute and hour hands, or the like can be displayed.

Figure 14:
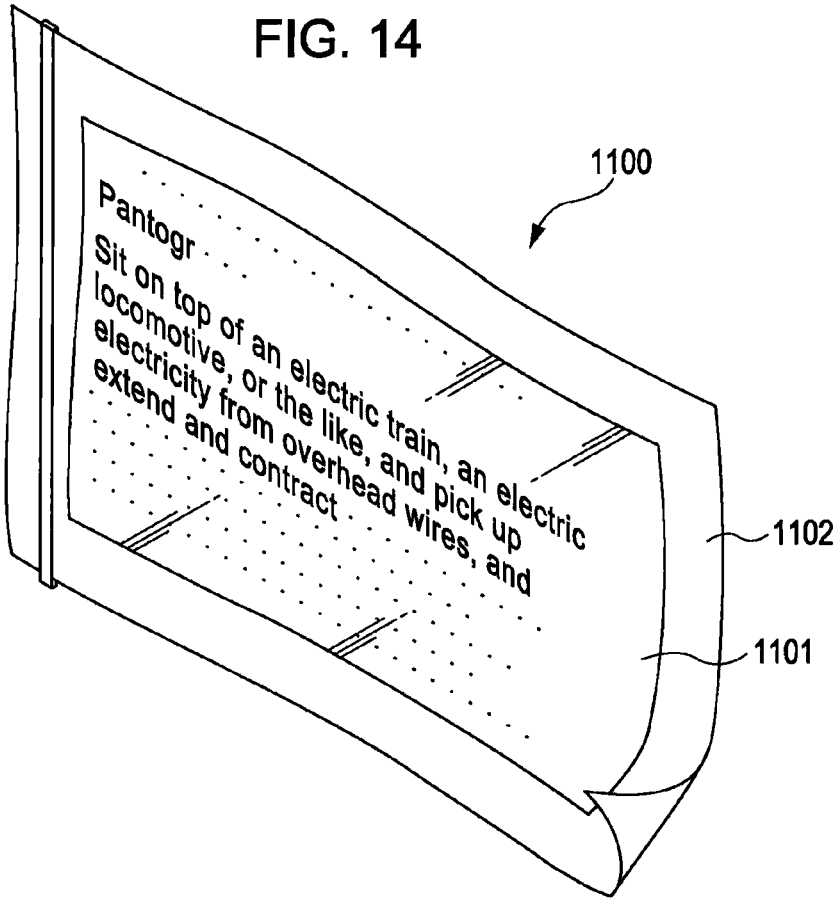
FIG. 14 shows an exemplary electronic device.

FIG. 14 is a perspective view showing the structure of electronic paper 1100. The electronic paper 1100 has the electrophoretic display device of one of the above-described embodiments in a display region 1101. The electronic paper 1100 has flexibility and is configured to include a body 1102 made of a rewritable sheet having a texture and a flexibility similar to those of an existing paper sheet.

Figure 15:
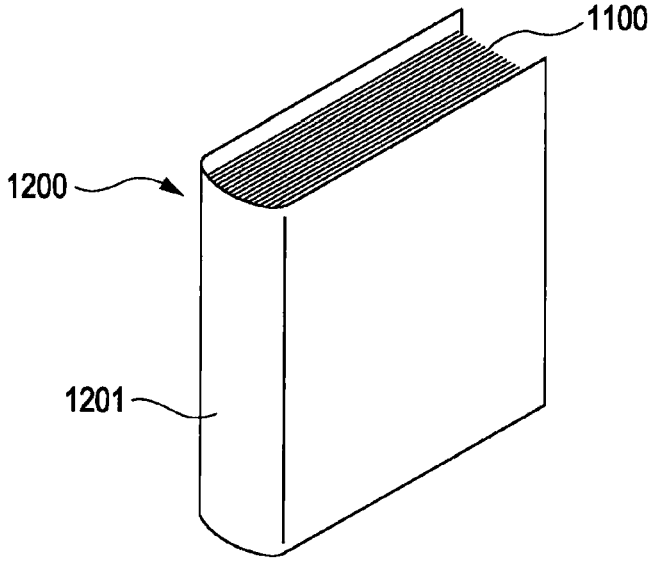
FIG. 15 shows an exemplary electronic device.

FIG. 15 is a perspective view showing the structure of an electric notebook 1200. The electric notebook 1200 is such that a plurality of pieces of the electronic paper 1100 mentioned above are bundled and are held with a cover 1201. The cover 1201 includes a display data inputting section, which is not shown, for inputting display data transmitted from an external device, for example. Thus, the display content can be changed and updated in accordance with the display data under a condition in which the electronic paper remains bundled.

In the above-described watch 1000, the electronic paper 1100 and the electric notebook 1200, the electrophoretic display devices according to some aspects of the invention are adopted. An electronic device that includes a displaying portion capable of display in which display irregularities are reduced is thus provided.

Note that the above-described electronic devices are examples of the electronic device according to the aspects of the invention, and do not limit the scope of the invention. For example, it is possible to preferably use the electrophoretic display device according to the aspects of the invention for display sections of electronic devices such as cellular phones and portable audio devices.

The entire disclosure of Japanese Patent Application No. 2009-243386, filed Oct. 22, 2009 is expressly incorporated by reference herein.

What is claimed is:

1. An electrophoretic display device configured such that an electrophoretic element is sandwiched between a pair of substrates and including a display section having a plurality of pixels arranged therein, the electrophoretic display device comprising:

a controller for controlling the display section;

scanning lines, data lines, power supply lines and enable lines provided in the display section, the scanning lines, the data lines, the power supply lines and the enable lines being connected to the pixels;

an enable line control circuit having switch circuits provided so as to correspond to a plurality of the enable lines, and a first power supply line and a second power supply line connected to the enable line control circuit; and in each of the pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode, the enable transistor switching electrical connection between the pixel electrode and the driving transistor on the basis of a signal input through one of the enable lines, wherein the controller performs, when displaying an image on the display section, an initialization driving operation for initializing a source potential and a gate potential of the driving transistor to have a certain potential relationship, a threshold voltage correcting operation for correcting a threshold voltage of the driving transistor, a mobility correcting operation for correcting mobility of the driving transistor, and an image displaying operation for driving the electrophoretic element, the controller turns on the enable transistor to correct the plurality of the pixels to a given gradation during the initialization driving operation, further wherein one of the switch circuits has a first transistor inserted between one of the enable lines and the first power supply line, and a second transistor inserted between the enable line and the second power supply line, and a gate of the first transistor is connected to a first one of the scanning lines to which the switch circuit belongs, and a gate of the second transistor is connected to a second one of the scanning lines that is different from the first scanning line.

2. The electrophoretic display device according to claim 1, wherein the controller turns off the enable transistor in periods of the threshold voltage correcting operation and the mobility correcting operation.

3. An electronic device comprising the electrophoretic display device according to claim 1.

4. The electrophoretic display device according to claim 1, further comprising:

a third power supply line connected to the enable line control circuit, wherein the switch circuit has a third transistor inserted between the enable line and the third power supply line, and a gate of the third transistor is connected to a third one of the scanning lines or another control line, the third scanning line being different from the first and second scanning lines.

5. The electrophoretic display device according to claim 1, wherein the switch circuit has a capacitor having one electrode connected to the enable line.

6. An electrophoretic display device configured such that an electrophoretic element is sandwiched between a pair of substrates and including a display section having a plurality of pixels arranged therein, the electrophoretic display device comprising:

scanning lines, data lines, power supply lines and enable lines provided in the display section, the scanning lines, the data lines, the power supply lines and the enable lines being connected to the pixels;

an enable line control circuit having switch circuits provided so as to correspond to a plurality of the enable lines, and a first power supply line and a second power supply line connected to the enable line control circuit; and in each of the pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode, the enable transistor switching electrical connection between the pixel electrode and the driving transistor on the basis of a signal input through one of the enable lines, wherein one of the switch circuits has a first transistor inserted between one of the enable lines and the first power supply line, and a second transistor inserted between the enable line and the second power supply line, a gate of the first transistor is connected to a first one of the scanning lines to which the switch circuit belongs, and a gate of the second transistor is connected to a second one of the scanning lines that is different from the first scanning line.

7. The electrophoretic display device according to claim 6, further comprising a third power supply line connected to the enable line control circuit, wherein the switch circuit has a third transistor inserted between the enable line and the third power supply line, and a gate of the third transistor is connected to a third one of the scanning lines or another control line, the third scanning line being different from the first and second scanning lines.

8. The electrophoretic display device according to claim 6, wherein the switch circuit has a capacitor having one electrode connected to the enable line.

9. A method of driving an electrophoretic display device, the electrophoretic display device configured such that an electrophoretic element is sandwiched between a pair of substrates and including a display section having a plurality of pixels arranged therein, the electrophoretic display device including scanning lines, data lines, power supply lines and enable lines provided in the display section, the scanning lines, the data lines, the power supply lines and the enable lines being connected to the pixels; an enable line control circuit having switch circuits provided so as to correspond to a plurality of the enable lines, and a first power supply line and a second power supply line connected to the enable line control circuit, one of the switch circuits has a first transistor inserted between one of the enable lines and the first power supply line, and a second transistor inserted between the enable line and the second power supply line, a gate of the first transistor is connected to a first one of the scanning lines to which the switch circuit belongs, and a gate of the second transistor is connected to a second one of the scanning lines that is different from the first scanning line; and, in each of the pixels, a pixel electrode, a control transistor connected to one of the scanning lines and one of the data lines, a driving transistor having a gate connected to a drain of the control transistor and having a drain connected to one of the power supply lines, a storage capacitor connected to the gate and a source of the driving transistor, and an enable transistor connected between the source of the driving transistor and the pixel electrode, the enable transistor switching electrical connection between the pixel electrode and the driving transistor on the basis of a signal input through one of the enable lines, the method comprising:

displaying an image on the display section, including:

initializing a source potential and a gate potential of the driving transistor to have a certain potential relationship, correcting a threshold voltage of the driving transistor, correcting mobility of the driving transistor, and driving the electrophoretic element, during the initializing, correcting the plurality of the pixels to a given gradation, wherein, in the correcting of the plurality of the pixels, the enable transistor is in an on-state, wherein, in the correcting of the threshold voltage and the correcting of the mobility, the enable transistor is in an off-state.

10. The method according to claim 9, wherein on-off control of the enable transistor is performed by using a potential of a first one of the scanning lines, the first scanning line being connected to the pixel to which the enable transistor belongs, and a potential of a second one of the scanning lines, the second scanning line being different from the first scanning line.

11. The method according to claim 10, wherein, after the on-off control has been performed by using the potentials of the first and second scanning lines, on-off control of the enable transistor is performed by using a potential of a third one of the scanning lines, the third scanning line being different from the first and second scanning lines.

12. The method according to claim 9, a potential supplied to the power supply line is switched in synchronization with an operation of selecting a first one of the scanning lines that is connected to the same one of the pixels as the power supply line, and an operation of selecting a second one of the scanning lines that is subsequent to the first scanning line.

* * * * *